United States Patent [19]

Naz

[11] 4,094,115

[45] June 13, 1978

[54] SELF-COMPENSATING SIDING OR ROOFING STRIP

[76] Inventor: Paul Naz, 20502 Harper, Harper Woods, Mich. 48225

[21] Appl. No.: 762,847

[22] Filed: Jan. 27, 1977

[51] Int. Cl.[2] ..... E04D 3/362

[52] U.S. Cl. ..... 52/521; 52/531

[58] Field of Search ..... 52/518, 519, 521, 522, 52/531, 555

[56] References Cited

U.S. PATENT DOCUMENTS

| | | | |
|---|---|---|---|
| 1,428,169 | 9/1922 | Laist et al. | 52/531 |
| 1,700,138 | 1/1929 | Murray, Jr. | 52/531 |
| 2,766,861 | 10/1956 | Abramson | 52/531 |
| 2,781,877 | 2/1957 | Ochiltree | 52/521 |
| 2,948,367 | 8/1960 | Uglietto | 52/531 |
| 3,135,070 | 6/1964 | Waring et al. | 52/531 X |
| 3,157,003 | 11/1964 | Domar | 52/531 |
| 3,394,520 | 7/1968 | Skelton, Jr. | 52/521 |
| 3,417,531 | 12/1968 | Jones | 52/555 X |
| 3,504,467 | 4/1970 | Hatch et al. | 52/521 X |

*Primary Examiner*—Alfred C. Perham
*Attorney, Agent, or Firm*—Cullen, Settle, Sloman & Cantor

[57] ABSTRACT

An integrally formed, interlocking siding or roofing strip assembly for covering a surface of a building. The strip includes a central panel, a lower spacing element, an upper assembly for operatively engaging the lower spacing element of another strip to be installed so as to interlock the strips in a partially overlapping manner, one above the other. The top end portion of the strip is provided with a plurality of generally vertically aligned corrugations having alternate ridge and valley portions. Fastening elements penetrate some of the valley and/or ridge portions to securely anchor the strips to the building surface. The corrugations serve (1) to compensate for expansions and contractions caused by aging and/or weather variations and (2) to continually bias the fastening elements to tightly anchor the strip to the surface in a spring-like manner thereby preventing the strips from becoming loose and eliminating noise and rattling. The corrugations may be provided with a plurality of apertures for operatively receiving the fastening elements and the thickness of the top end portion which is corrugated may be less than the thickness of the central panel to facilitate the compensation function of the corrugations.

10 Claims, 7 Drawing Figures

SELF-COMPENSATING SIDING OR ROOFING STRIP

BACKGROUND OF THE INVENTION

The invention relates to a siding or roofing strip and more particularly to an interlocking siding or roofing strip provided with a corrugated portion adapted to be securely fastened to the surface being covered in such a manner so as to automatically compensate for expansions and contractions while simultaneously serving to self-bias the strip tightly against the surface to prevent loosening and noise.

The prior art teaches many different types of interlocking siding sheets for protectively and/or decoratively covering the inside and/or outside walls of a building or trim portions thereof. Similarly, the prior art teaches many different types of interlocking roofing strips or shingles adapted to be secured to the roof portion of a building in a partially overlapping manner, one above the other.

The prior art siding or roofing strips which are capable of interlocking are often relatively complex structures which are relatively expensive to make and difficult to install and maintain. Most of the siding or roofing strips of the prior art become loose with age or through exposure to variations in the weather since both of these conditions may result in expansions and contractions of the sliding or roofing strips themselves, of the fastening elements used to anchor the strips, and/or of the material from which the surface of the building being covered is made.

When roofing or siding strips become loose, they can fall off leaving an unsightly blemish and an unprotected area on the previously covered surface. Water or the like may run under the roofing or siding and into the house causing property damage. A major problem which has not previously found a commercially acceptable solution is that of noise. When the roofing and/or siding strips become loose, even a gentle breeze may cause a whistling or rattling of the strips much to the annoyance of the inhabitants of the building.

None of the roofing and/or siding strips of the prior art, which are commercially feasible when cost considerations are taken into account, provide a means to prevent the strips from coming loose and none provide means whereby the strip may automatically compensate for expansions and contractions.

The present invention eliminates most of the deficiencies of the prior art and provides an integrally formed interlocking siding strip which is not only capable of mechanically interlocking with previously installed strips but which self-compensates for expansions and contractions while simultaneously self-biasing the fastening the elements to tightly anchor the strip to the surface in a spring-like manner so as to prevent the strips from coming loose and eliminating noise.

SUMMARY OF THE INVENTION

The present invention involves an integrally formed interlocking strip for use as siding, roofing and the like to cover inside or outside surface areas of a building. The interlocking strips of the present invention include a generally rectangular panel having interior and exterior surfaces. A first spacing assembly integral with and extending outwardly from the exterior surface of the panel is disposed a predetermined distance from the upper end portion thereof for operatively engaging the lower end portion of a strip to be installed for interlocking purposes. A second spacing assembly integral with and extending outwardly from the interior surface of the panel adjacent to the lower end portion thereof is provided for spacing the lower end portion of the panel a spaced distance away from the surface of the building being covered while operatively engaging the first assembly of a previously installed strip for mechanically interlocking the strips together one above the other in a partially overlapping manner. A predetermined section of the upper end portion which is disposed between the first assembly and the upper end of the panel is provided and includes corrugation means having alternate ridge and valley portions adapted to engagably receive fastening means therethrough for fixedly anchoring the strip to the surface of the building being covered. The corrugation means cooperates with the building surface being covered and the fastening means for (1) automatically compensating for expansion and contraction of the strips with changing weather conditions and/or with aging and (2) achieving a spring-type buckle washer effect to self-bias the predetermined section of the upper end portion and the fastening means for maintaining a tight fit therebetween, thereby preventing the strips from working loose and eliminating rattling and the like.

The present invention may include a plurality of apertures provided through the corrugation means for operatively receiving a portion of the fastening means therein to secure the strip to the surface of the building being covered so at achieve the self-biasing effect.

With or without the apertures through the corrugation means, in the preferred embodiment of the present invention, the fastening means includes a nail-like element having an elongated body having a point at one end thereof and a head at the opposite end thereof. The elements is adapted to be driven or received through at least one of the valley portions of the corrugation means such that the pointed end of the element is securely anchored in the surface of the building being covered while the head of the element operatively engages the sides of the at least one valley portion to bear inwardly thereon, thereby achieving the spring-type buckle washer or self-biasing effect tending to tightly bias the strip securely to the surface while the corrugation means remains free to compensate for expansions and contractions.

Similarly, with or without the apertures through the corrugation means, the nail-like element is adapted to be driven or received through at least one of the ridge portions of the corrugation means such that the pointed end of the element is anchored in the surface of the building being covered while the head of the element operatively engages portions of the ridge adjacent to the point of penetration of the element to bear inwardly thereon thereby achieving the spring-type of buckle washer effect tending to tightly bias the strip securely to the surface while the corrugation means remains free to compensate for expansions and contractions.

The strip of the present invention may also be adapted so that the thickness of the corrugated upper section of the panel is less than the thickness of the panel itself to facilitate the ability of the corrugation means to compensate for expansions and contractions. Furthermore, in the preferred embodiment of the present invention, the entire strip is an integrally formed unit comprising durable, weather resistant plastic material such as vinyl or the like.

In the preferred embodiment of the present invention, the second spacing assembly may include a generally L-shaped element adapted to perform the spacing function and to interlock with the first interlocking assembly of a previously installed strip while the first spacing and interlocking assembly includes a generally h-shaped element which is adapted to operatively receive one leg of the L-shaped element of next strip to be installed for interlocking the strips one above the other in a partially overlapping manner.

The integrally formed, interlocking strip of the present is useful as siding, roofing or the like. It is capable of serving a protective and/or decorative function, and it may be adapted for use on internal as well as external surfaces of a building. The interlocking strip of the present invention is a simple economical article which is both easy to install and easy to maintain.

The interlocking strip of the present invention is able to attain a mechanical interlock of one strip above the other in a partial overlapping fashion while simultaneously providing means for compensating for expansions and contractions such as those which may result from aging and/or from variations in weather and the like. Furthermore, the thickness of the corrugated section of the interlocking strip of the present invention may be reduced to even further facilitate the expansion and contraction compensation function of the present invention.

Furthermore, the interlocking strip of the present invention allows for mechanical interlock and a partial overlap of the strips one above the other while simultaneously providing for self-biasing to keep the strips tightly secured to the surface of the building covered so as to prevent loose strips and eliminate noise and rattling.

The integrally formed interlocking strip of the present invention enables the strips to be mechanically interlocked one above the other in a partial overlapping manner while simultaneously providing for the dual functions of (1) self-compensating for expansions and contractions and (2) self-biasing to prevent the strips from coming loose thereby far exceeding the performance characteristics of any commercially feasible siding or roofing strip of the prior art.

Other advantages and meritorious features of the present invention will be more fully understood from the following detailed description of the drawings in the preferred embodiment, the appended claims and the drawings which are described briefly hereinbelow.

DESCRIPTION OF THE PREFERRED EMBODIMENT

Figure 1:
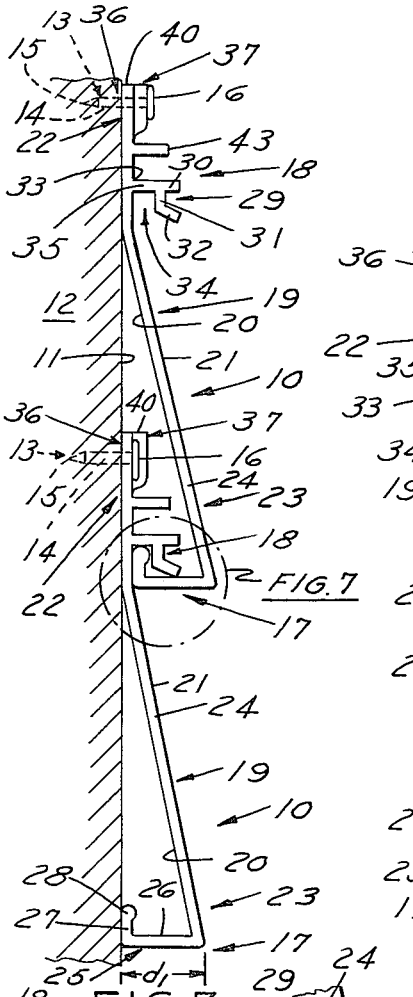
FIG. 1 is a partial side view illustrating the roofing or siding strips of the present invention as they would be installed to cover a surface such as the side of a building.

FIG. 1 is a fragmentary side view illustrating the roofing or siding strips 10 of the present invention as they would be installed to cover a surface 11 such as the side of a building 12. The top of the lower strip 10 is securely anchored to the surface 11 of the building 12 by means of a fastening element 13, such as a nail having a elongated body portion 14 with a point 15 at one end and a head portion 16 at the other end of the elongated body portion 14.

Figure 7:
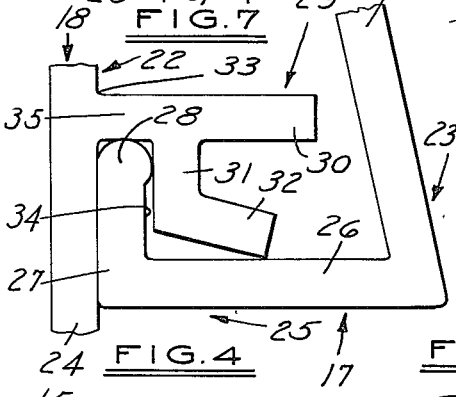
FIG. 7 is a detailed view of that portion of FIG. 1 where the upper and lower strips interlock.

As illustrated in FIGS. 1 and 7, the lower spacing configuration or assembly 17 of the upper strip 10 which is to be installed over the surface 11 of the building 12 is retainably received within the upper interlocking configuration or assembly 18 of the previously installed strip 10 so as to mechanically interlock the upper and lower strips 10 so that only the top portion of each newly installed strip need be mechanically secured or anchored to the surface 11 of the building 12 by means of fastening elements 13.

The interlocking siding or roofing strip 10 of the present invention (hereinafter referred to as strip) will now be described with reference to FIGS. 1 and 2. The strip 10 includes a generally rectangular panel 19 having an interior surface 20, an exterior surface 21, an upper portion end portion 22, a lower end portion 23, and an intermediate central portion 24 between the end portions 22, 23.

The lower spacing and interlocking configuration or assembly 17 is integral with and extends outwardly from the interior surface 20 of the panel 19 adjacent the distal end of the lower end portion 23 thereof for spacing the lower end portion 23 a predetermined spaced distance "$d_1$" away from the surface 11 of the building 12 or away from the surface of a previously installed strip 10 while operatively engaging the upper spacing and interlocking configuration or assembly 18 of a previously installed strip 10 (except for the bottom row of strips 10) so as to mechanically interlock the two strips 10 one above the other in a partially overlapping manner, as shown in FIG. 1.

The lower spacing and interlocking assembly 17 includes a generally L-shaped element 25 having one leg portion 26 integrally abutting the distal end of the lower end portion 23 of the panel 19 and disposed outwardly therefrom generally perpendicular to the plane of the interior surface 20 of the central portion 24 of the panel 19. The bight of the L-shaped element 25 is disposed upwardly toward the upper end portion 22 and the other leg portion 27 of the L-shaped element 25 is disposed upwardly from the leg portion 26 and is generally parallel to the plane of the interior surface 20 of the lower end portion 23. A beaded lip 28 may be provided at the distal end of the other leg portion 27, as shown in FIG. 1, if desired.

The upper spacing and interlocking configuration or assembly 18 is integral with and extends outwardly from the plane of the exterior surface 21 of the panel 19 and is disposed a predetermined distance "$h_2$" from the upper distal end of the upper end portion 22 of the panel 19. The upper interlocking configuration 18 serves to space the lower end portion 23 of a later installed strip 10 while operatively engaging the lower spacing configuration 17 thereof for mechanically interlocking the strips 10.

The upper interlocking configuration 18 includes a generally h-shaped element 29 having a long leg or portion 30, a cross bar portion 31 and a short leg portion 32. The top distal end 33 of the long leg 30 of the h-shaped element 29 integrally abuts the exterior surface 21 of the panel 19 so that the long leg 30 is generally perpendicular to the plane of the exterior surface 21 of the panel 19 where the upper end portion 22 merges with the interior central portion 24. The cross bar portion 31 is disposed downwardly towards the lower end portion 23 and is generally parallel to the plane of the exterior surface 21 of the panel 19 to form a locking space 34 bounded by the exterior surface 21, the upper part 35 of the long leg 30, and the cross bar portion 31. The short leg 32 of the h-shaped element 29 is disposed outwardly from the cross bar portion 31 and away from the exterior surface 21 such that an acute angle "$\alpha$" is formed with the downwardly extended plane of the cross bar portion 31. The locking space 34 is adapted to operatively engage the beaded lip 28 and other leg portion 27 of the L-shaped element 25 of the lower spacing configurations 17 so as to mechanically interlock the strips 10, one above the other, in a partially overlapping manner as shown in FIG. 1.

Figure 2:
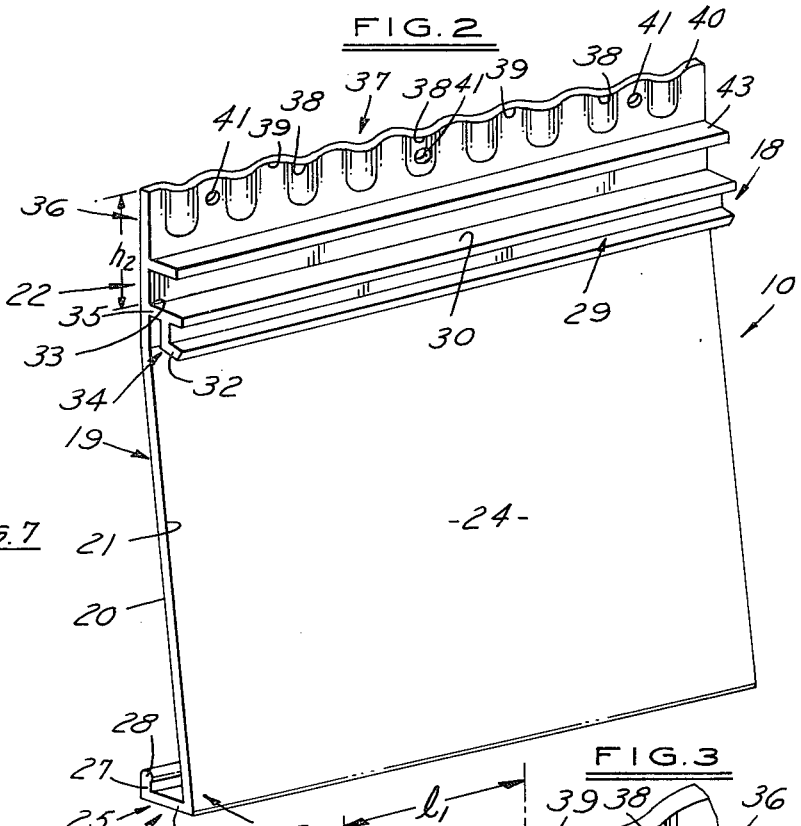
FIG. 2 is a perspective view of a siding or roofing strip of the present invention.
Figure 3:
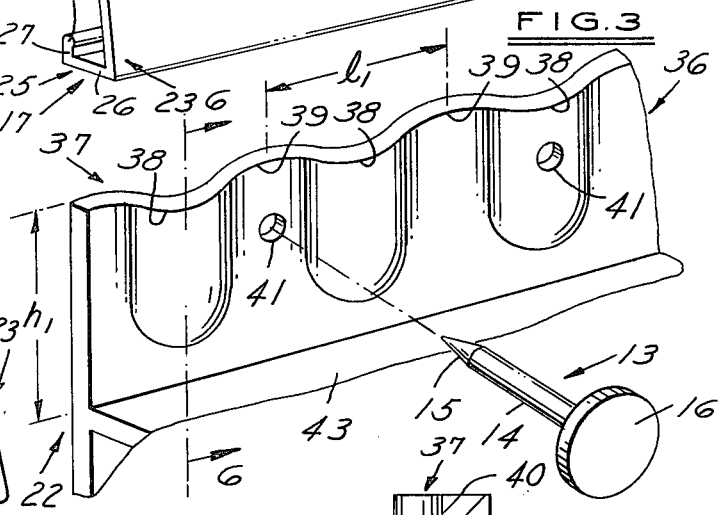
FIG. 3 is a blow-up, fragmentary, perspective view of a portion of the corrugated top portion of the siding or roofing strip of the present invention.
Figure 4:
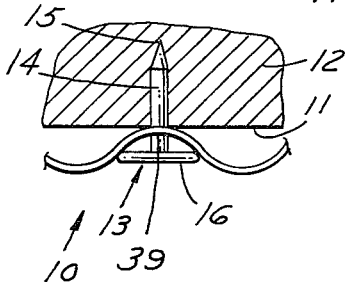
FIG. 4 is a fragmentary top view showing a fastening element pentrating the valley portion of a corrugation to secure the strip to a surface so as to achieve the spring-like self-biasing effect of the present invention.
Figure 5:
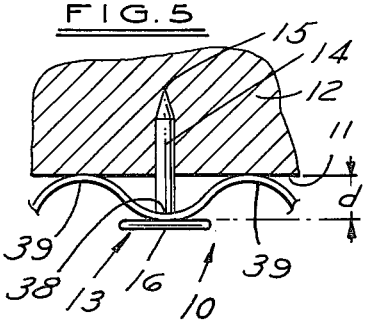
FIG. 5 is a fragmentary top view showing a fastening element pentrating the ridge portion of a corrugation to secure the strip to a surface to achieve the spring-like self-biasing effect of the present invention.

As illustrated in FIGS. 2 and 3, a predetermined elongated section or portion 36 of the upper end portion 22 of the panel 19 (having a height "$h_1$") is provided which is disposed between a ledge portion 43 parallel to and spaced from the upper interlocking configuration 18 and the distal end or edge 40 of the upper end portion 22. The section or portion 36 is provided with a plurality of corrugations 37 having alternate ridge portions 38 and valley portions 39 which are adapted to engagably receive the fastening elements 13 therethrough for fixedly securing the strip 10 to the surface 11 of the building 12 as shown in FIGS. 1, 4 and 5. The corrugations 37 are generally vertically aligned and extend a distance "$h_1$" from the distal end 40 of the upper end portion 22 of the panel 19.

The corrugations 37 serve a dual function in the interlocking strip 10 of the present invention. In the first place, the corrugations 37 provide a means whereby the strip 10 is able to self-compensate for expansions and contractions such as may be produced in the strips 10 with changing weather conditions and/or aging. Simultaneously, the corrugations 37 provide a means whereby the fastening elements 13 secure the strips 10 to the surface 11 with a spring-type buckle washer or self-biasing effect for maintaing a tight fit between the strip 10, the surface 11, and the fastening element 13 thereby preventing the strips 10 from working loose from the surfaces 11 and eliminating noise such as rattling and the like.

Figure 6:
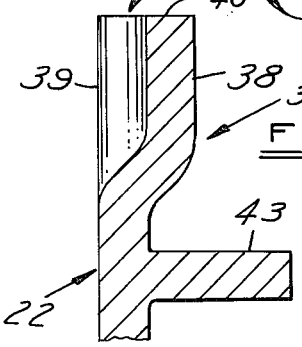
FIG. 6 is a sectional side view of a corrugation taken along view lines 6—6 of FIG. 5.

As shown in FIGS. 3 and 6, the ridge portions 38 and/or the valley portions 39 of the corrugations 37 may be provided with apertures 41 adapted to receive the elongated body portion 14 of the fastening elements 13 therethrough to facilitate securing the strip 10 to the surfaces 11.

FIGS. 4 and 5 show the means whereby the spring-type buckle washer or self-biasing effect is achieved. In FIG. 4, the elongated body portion 14 of the fastening element 13 has penetrated the valley portion 39 so as to securely anchor the pointed end portion 15 of the fastening element 13 within the surface 11 of the building 12. As illustrated by the arrows of FIG. 4, the undersurfaces or edges of the head portion 16 of the fastening element 13 bear inwardly on the sides of the valley portion 39 while the bottom of the valley portion 39 pushes against and away from the surface 11, resulting in a spring-type buckle washer effect which maintains a tight fit between the strip 10, the surface 11, and the fastening element 13 which prevents the strips 10 from working loose even during expansions and contractions.

Similarly, in FIG. 5, the elongated body portion 14 of the fastening element 13 has penetrated the exterior peak of the ridge portion 38 and the pointed end 15 has been fixidly embedded in the surface 11. The under surface portions of the head 16 of the fastening element 13 bear inwardly against the slopes of the ridge portions 38 as indicated by the inwardly directed solid arrows to counter the outward bias generated by the contact of the valley portions 39 with the surface 11, as indicated by the outwardly directed solid arrows, resulting in a spring-type buckle washer or self-biasing effect for maintaining a tight fit between the strip 10, the surface 11, and the fastening element 13 even during expansions and contractions.

In the preferred embodiment of the present invention, the entire interlocking strip 10 is an integrally formed unit comprising a durable, weather-resistant plastic material such as vinyl or the like although any conventional siding or roofing material can be adapted to the present invention with considerable success. In the preferred embodiment, the thickness of the internal intermediate central portion 24 of the panel 19 was preferable 0.040 inches while the thickness of the corrugated elongated section or portion 36 is preferable slightly less to further facilitate the ability of the strip 10 to compensate for expansions and contractions.

The length of the first leg portion 26 of the L-shaped element 25 is preferably 0.625 inches while the length of the other leg portion 27 is preferably 0.375 inches. In the preferred embodiment, the distance "$l_1$" between adjacent ridge portions 38 or valley portions 39 of the corrugations 37 is one inch. The height "$h_2$" between distal end 40 of the upper end portion 22 and the upper iterlocking configuration 18 is 1 inch while the height "$h_1$" of the corrugations 37 themselves and hence of the predetermined elongated seection or portion 36 is 0.875 inches. The distance "$d$" shown in FIG. 5 is the perpendicular distance between a plane tangent to the peaks of the ridge portions 38 and a plane tangent to the bottom of the valley portions 39 and is preferably 0.25 inches to permit sufficient room for expansion and contraction.

It will of course be realized that these dimensions and the materials set forth herein are illustrative only. It will be realized that the strips 10 of the present invention may be used both inside and outside of buildings and may be used for siding, roofing, or other purposes, both functional and decorative. For example, the present invention may be used to simulate brick, stone or wood paneling and the like.

With this detailed description of the specific apparatus used to illustrate the prime embodiment of the present invention and the operation thereof, it will be obvious to those skilled in the art that various modifications can be made in the present strip and the interlocking configuration therefor, and in the materials recited herein without departing from the spirit and scope of the present invention which is limited only by the appended claims.

I claim:

1. An integrally formed, interlocking strip for use as siding, roofing and the like to cover surface areas of buildings comprising:

a generally rectangular panel having an interior surface, an exterior surface, an upper end portion, a lower end portion and a generally flat intermediate central portion between said upper and lower end portion, said upper end portion being generally coplanar with said intermediate central portion and the interior surface of said upper end portion being integrally contiguous with the interior surface of said intermediate central portion;

a first spacing and interlocking assembly integral with and extending outwardly from said exterior surface of said panel and disposed a first distance from the distal end of said upper end portion for spacing the lower end portion of a later installed strip while operatively engaging same for interlocking purposes;

a second spacing and interlocking assembly integral with and extending outwardly from said interior surface of said panel adjacent said lower end portion thereof for spacing said lower end portion a second spaced distance away from the surface of said building being covered while operatively engaging said exteriorly extending first assembly of a previously installed strip for interlocking said strips together one above the other; and only a portion of said upper end portion disposed between said first assembly and the distal end of said upper end portion including corrugation means extending from said upper distal end toward and terminating short of said first distance, said corrugation means having alternate ridge and valley portions adapted to engagably receive fastening means therethrough for fixedly securing said strip to the surface of said building being covered, said corrugation means cooperating with said building surface being covered and said fastening means for (1) compensating for expansion and contraction of said strips with changing weather conditions and (2) achieving a spring-type buckle washer effect for maintaining a tight fit therebetween thereby preventing said strips from working lose and eliminating rattling and the like.

2. The interlocking strip of claim 1 wherein said corrugation means includes a plurality of apertures therethrough for operatively receiving a portion of the fastening means therein to secure said strip to the surface of said building being covered.

3. The interlocking strip of claim 1 wherein said fastening means includes a nail-like element having an elongated body having a point at one end thereof, said element being adapted to be driven through at least one of said valley portions of said corrugation means such that said pointed end of said element is anchored in the surface of said building being covered while the head of said element operatively engages the sides of said at least one valley portion to bear inwardly thereon thereby achieving said spring-type buckle washer effect tending to tightly bias said strip securely to said surface while said corrugation means remains free to compensate for expansions and contractions.

4. The interlocking strip of claim 1 wherein said fastening means includes a nail-like element having an elongated body having a point at one end thereof and a head at the opposite end thereof, said element being adapted to be driven through at least one of said ridge portions of said corrugation means such that the pointed end of said element is anchored in the surface of the building being covered while the head of said element operatively engages portions of said at least one ridge portion adjacent the point of penetration of said element to bear inwardly thereon thereby achieving said spring-type buckle washer effect tending to tightly bias said strip securely to said surface while said corrugation means remains free to compensate for expansions and contractions.

5. The interlocking strip of claim 1 wherein the thickness of said first portion is less than the thickness of said panel to facilitate the ability of said corrugation means to compensate for expansions and contractions.

6. The interlocking strip of claim 1 wherein said second spacing and interlocking assembly includes a generally L-shaped element having one leg portion integrally abutting the distal end of said lower end portion and disposed outwardly from and generally perpendicular to the interior surface of said panel, the bight of said L-shaped element being disposed upwardly toward said upper end portion and the other leg of said L-shaped element being disposed upwardly and generally parallel to the plane of said lower end portion.

7. The interlocking strip of claim 6 wherein said first spacing and interlocking assembly includes a generally h-shaped element integral with the exterior surface of said panel and extending outwardly therefrom, the top distal end of the long portion of said h-shaped element integrally abutting said exterior surface such that said long portion is generally perpendicular to the plane of said exterior surface and the cross-bar and short portions of said h-shaped element being disposed downwardly towards said lower end portion, said cross-bar portion being disposed generally parallel to the plane of said exterior surface to form a locking space bounded by said exterior surface, the upper part of said long portion and said cross-bar portion, said short portion being disposed outwardly from said cross-bar portion and at an acute angle with respect to an extension thereof, said locking space being adapted to operatively receive said other leg of said L-shaped element while said one leg portion is disposed against said short portion for interlocking said strips one above the other in a partially overlapping manner.

8. An improved siding or roofing-type strip having a generally flat central panel, a lower end portion integral with and extending rearwardly from said central panel for spacing the lower end portion of said strip a first distance away from the surface of the building being covered by said strips, an upper portion integral with and extending forwardly from said central panel for operatively engaging the lower end portion of a strip to be installed for interlocking said strips one above the other in a partially overlapping manner, the improvement comprising an elongated upper end portion having a first end and a second end, said second end integral with both said central panel and said upper portion, said elongated upper end portion being generally coplanar with said generally flat central panel, said elongated upper end portion including a plurality of generally vertically aligned corrugations extending from said first end toward and terminating short of said second end, said corrugations having alternated ridge and valley portions formed therein for (1) compensating for expansions and contractions of said strips with aging and changing weather conditions and (2) effecting a spring-type bias tending to keep said strip tightly secured to the surface of said building being covered thereby preventing the strips from becoming loose and eliminating noise.

9. The improved strip of claim 8 wherein fastening elements are used to secure said strips to said building surface being covered and wherein at least one of said ridge and valley portions of said corrugations are provided with apertures for operatively receiving at least a portion of one of said fastening elements therethrough to anchor said strip to said building surface while simultaneously providing for the compensating and biasing functions of said corrugations.

10. The improved strip of claim 8 wherein fastening elements are used to secure said strips to said building surface being covered and wherein at least one of said ridge and valley portions are adapted to penetratably receive at least a portion of said fastening elements therethrough to anchor said strip to said building surface while simultaneously enabling said corrguations to perform said compensating and biasing functions.

* * * * *